United States Patent [19]

Otsuka et al.

[11] 4,450,812

[45] May 29, 1984

[54] ELECTRIC CONTROL SYSTEM FOR INTERNAL COMBUSTION ENGINES, HAVING FAIL SAFE FUNCTION FOR ENGINE CONDITION DETECTING SENSORS

[75] Inventors: Kazuo Otsuka, Higashikurume; Shin Narasaka, Yono; Shumpei Hasegawa, Niiza, all of Japan

[73] Assignee: Honda Giken Kogyo Kabushiki Kaisha, Tokyo, Japan

[21] Appl. No.: 296,913

[22] Filed: Aug. 27, 1981

[30] Foreign Application Priority Data

Sep. 2, 1980 [JP] Japan ..... 55-122097

[51] Int. Cl.[3] ..... F02M 7/12

[52] U.S. Cl. ..... 123/438; 123/440; 123/479; 123/589

[58] Field of Search ..... 123/479, 488, 489, 438, 123/440, 589, 198 D, 494; 340/52 F

[56] References Cited

U.S. PATENT DOCUMENTS

| | | | |
|---|---|---|---|
| 3,834,361 | 9/1974 | Keely | 123/479 |
| 3,938,075 | 2/1976 | Reddy | 123/479 |
| 3,964,018 | 6/1976 | Strait et al. | 340/52 F |
| 4,036,186 | 7/1977 | Hattori et al. | 123/438 |
| 4,138,979 | 2/1979 | Taplin | 123/489 |
| 4,202,301 | 5/1980 | Early et al. | 123/440 |
| 4,274,381 | 6/1981 | Abo | 123/440 |
| 4,287,504 | 9/1981 | Simon et al. | 340/52 F |
| 4,291,659 | 9/1981 | Suzuki et al. | 123/440 |

*Primary Examiner*—Andrew M. Dolinar
*Attorney, Agent, or Firm*—Lyon & Lyon

[57] ABSTRACT

An electric control system for controlling an internal combustion engine, which comprises sensor means for detecting at least one of operating condition of the engine and ambient condition in the vicinity of the engine to generate an output continuously variable with a change in the above at least one condition, comparator means for comparing the output of the sensor means with upper and lower limits which are set at values lying slightly beyond a normal range of values indicative of the at least one condition which can exist during normal operation of the engine, and generating a first signal when the output of the sensor means lies beyond the upper limit or the lower limit; and a timer arranged to generate a second signal is continuously generated over a predetermined period of time. The electric control system includes an air/fuel ratio control system for internal combustion engines.

12 Claims, 2 Drawing Figures

ELECTRIC CONTROL SYSTEM FOR INTERNAL COMBUSTION ENGINES, HAVING FAIL SAFE FUNCTION FOR ENGINE CONDITION DETECTING SENSORS

BACKGROUND OF THE INVENTION

This invention relates to an electric control system for controlling an internal combustion engine, which is provided with a fail safe function for sensors used therein for detecting operating condition of the engine and/or conditions of control of the engine, and more particularly to an air/fuel ratio control system provided with such function.

There have conventionally been proposed various types of electric control systems which are provided with various sensors for detecting operating condition of internal combustion engines and/or conditions of control of the engine, and are responsive to output signals of these sensors to electrically control the operation of the engines. The electric control systems include, for instance, air/fuel ratio control systems, fuel injection systems, and exhaust gas emission control systems.

One of the air/fuel ratio control systems has been proposed by the assignee of the present application, which is adapted to perform feedback control of the air/fuel ratio of an air/fuel mixture being supplied to an internal combustion engine having an intake pipe and which comprises an $O_2$ sensor for detecting the concentration of an exhaust gas ingredient emitted from the engine, a carburetor for producing the mixture being supplied to the engine, and means operatively connecting the $O_2$ sensor with the carburetor, the connecting means comprising an electrical circuit, an air/fuel ratio control valve and a pulse motor actuatable by a control signal supplied from the electrical circuit to drive the air/fuel ratio control valve.

This proposed air/fuel ratio control system is provided with sensors for detecting operating condition of the engine and conditions of control of the engine, such as an atmospheric pressure sensor, an intake pipe-absolute pressure sensor and an engine coolant temperature sensor. Responsive to output signals of these sensors, an electrical circuit formed of an electronic control unit (ECU) determines fulfillment of closed loop control conditions or open loop control conditions to generate a control signal corresponding to a fulfilled control condition to thereby drive the pulse motor and accordingly the air/fuel ratio control valve to control the air/fuel ratio to a predetermined value.

Therefore, in the event that there occurs abnormality in any one of the outputs of the atmospheric pressure sensors, the intake pipe-absolute pressure sensor and the engine coolant temperature sensor due to trouble in any one of the sensors per se or in the wiring system related to the sensors, the electrical circuit cannot properly determine fulfillment of the closed loop and open loop control conditions in response to actual operating condition and/or conditions of control of the engine, so that the air/fuel ratio is controlled to an abnormal value, which can spoil the driveability or exhaust emission characteristics of the engine or cause a misfire of the engine.

OBJECT AND SUMMARY OF THE INVENTION

It is therefore the object of the invention to provide an electric control system for internal combustion engines, inclusive of an air/fuel ratio control system, which is provided with a fail safe function which comprises detecting abnormality in the atmospheric pressure sensor, the intake pipe-absolute pressure sensor and the engine coolant temperature sensor per se or in the wiring system related to these sensors, on the basis of output signals generated by these sensors and taking necessary fail safe actions, to thereby eliminate the aforementioned disadvantages.

According to the invention, there is provided an electric control system for controlling an internal combustion engine, which comprises: sensor means for detecting at least one of operating condition of the engine and ambient condition in the vicinity of the engine to generate an output continuously variable with a change in the at least one condition: comparator means for comparing the output of the sensor means with an upper limit and a lower limit which are set at values lying slightly beyond a normal range of values indicative of the at least one condition which can exist during normal operation of the engine, and generating a first signal when the output of the sensor means lies beyond the upper limit or the lower limit; and a timer arranged to generate a second signal indicative of the occurrence of trouble when the first signal is continuously generated for a predetermined period of time.

The electric control system includes an air/fuel ratio control system for performing feedback control of the air/fuel ratio of an air/fuel mixture being supplied to an internal combustion engine having an intake pipe, which comprises: an $O_2$ sensor for detecting the concentration of an exhaust gas ingredient emitted from the engine; a carburetor for producing the mixture being supplied to the engine; and means operatively connecting the $O_2$ sensor with the carburetor in a manner effecting feedback control operation to control the air/fuel ratio of the mixture to a predetermined value in response to an output signal of the $O_2$ sensor, the connecting means comprising an electrical circuit, an air/fuel ratio control valve, and a pulse motor responsive to a control signal generated by the electrical circuit to drive the air/fuel ratio control valve.

The air/fuel ratio control system further includes means responsive to the second signal outputted from the above timer to memorize a corresponding failure code and display the occurrence of a fault, and means responsive to the same second signal to move the pulse motor to a position at which the pulse motor was located immediately before the generation of the second signal, or move the pulse motor to a predetermined position.

The above and other objects, features and advantages of the invention will be more apparent from the ensuing detailed description taken in connection with the accompanying drawings in which:

DETAILED DESCRIPTION

Details of the invention will now be described with reference to the drawings in which an embodiment of the air/fuel ratio control system according to the invention is illustrated.

Figure 1:
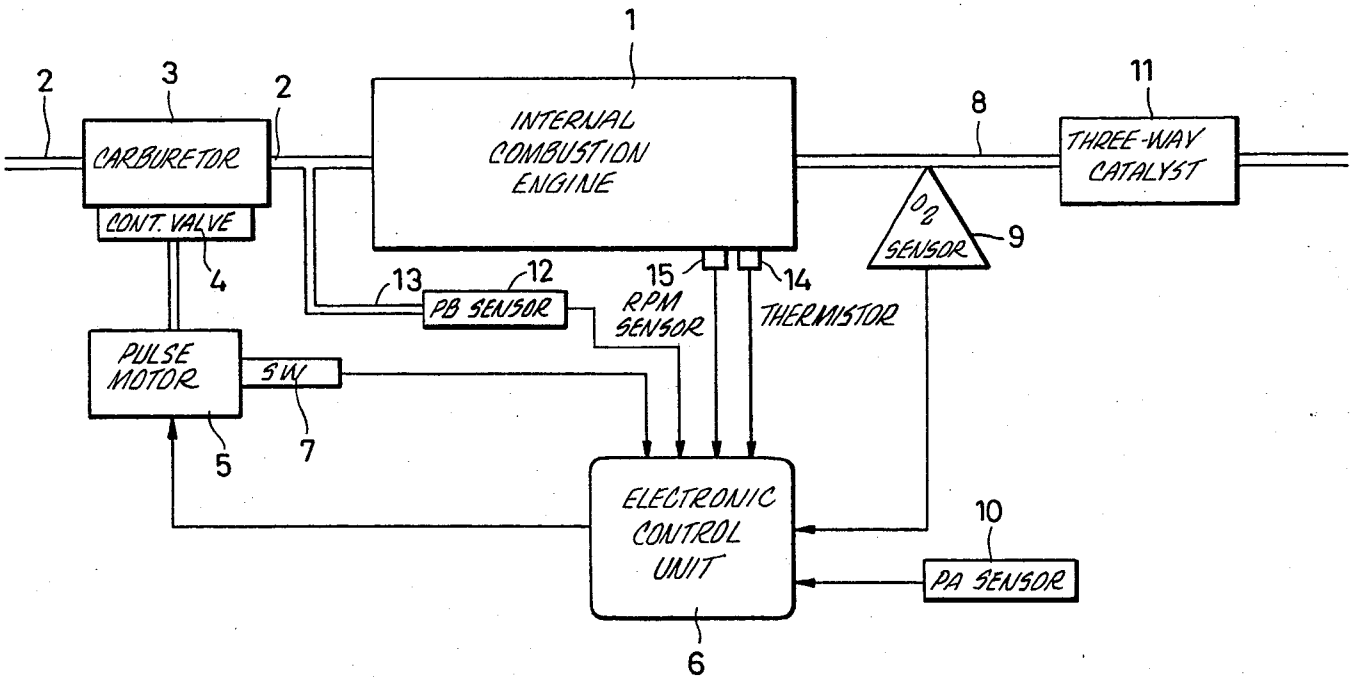
FIG. 1 is a block diagram illustrating the whole arrangement of an air/fuel ratio control system according to the invention.

Referring first to FIG. 1, there is illustrated a block diagram of the whole arrangement of the air/fuel ratio control system. Reference numeral 1 designates an internal combustion engine. Connected to the engine 1 is an intake manifold 2 which is provided with a carburetor generally designated by the numeral 3. The carburetor 3 has main and slow speed fuel passages, not shown, which communicate the float chamber, not shown, of the carburetor 3 with primary and secondary bores, not shown. These fuel passages communicate with the atmosphere by means of air bleed passages, not shown.

At least one of these fuel passages or air bleed passages is connected to an air/fuel ratio control valve 4. The air/fuel ratio control valve 4 is comprised of a required number of flow rate control valves, not shown, each of which is driven by a pulse motor 5 so as to vary the opening of the at least one of the above passages. The pulse motor 5 is electrically connected to an electronic control unit (hereinafter called "ECU") 6 to be rotated by driving pulses supplied therefrom so that the flow rate control valves are displaced to vary the flow rate of air or fuel being supplied to the engine 1 through the at least one passage. Although the air/fuel ratio can be controlled by thus varying the flow rate of air or fuel being supplied to the engine 1, a preferable concrete measure should be such as varies the opening of at least one of the aforementioned air bleed passages to control the flow rate of bleed air.

The pulse motor 5 is provided with a reed switch 7 which is arranged to turn on or off depending upon the moving direction of the valve body of the air/fuel ratio control valve 4 each time the same valve body passes a reference position, to supply a corresponding binary signal to ECU 6.

On the other hand, an $O_2$ sensor 9, which is formed of stabilized zirconium oxide or the like, is mounted in the peripheral wall of an exhaust manifold 8 leading from the engine 1 in a manner projected into the manifold 8. The sensor 9 is electrically connected to ECU 6 to supply its output signal thereto. An atmospheric pressure sensor 10 is arranged to detect the ambient atmospheric pressure surrounding the vehicle, not shown, in which the engine 1 is installed, the sensor 10 being electrically connected to ECU 6 to supply its output signal thereto, too.

A pressure sensor 12 is arranged in communication with the intake manifold 2 through a conduit 13 to detect the absolute pressure in the manifold 2, and also electrically connected to ECU 6 to supply its output signal thereto. A thermistor 14 is inserted in the peripheral wall of an engine cylinder, not shown, the interior of which is filled with engine cooling water, to detect the temperature of the engine cooling water, and also electrically connected to ECU 6 to supply its output signal thereto.

Incidentally, in FIG. 1, reference numeral 11 designates a three-way catalyst, and 15 generally designates an engine rpm sensor which is comprised of a distributor and an ignition coil and arranged to supply pulses produced in the ignition coil to ECU 6.

Details of the air/fuel ratio control which can be performed by the air/fuel ratio control system according to the invention outlined above will now be described by further reference to FIG. 1 which has been referred to hereinabove.

Initialization

Referring first to the initialization, when the ignition switch in FIG. 1 is set on, ECU 6 is initialized to detect the reference position of the actuator or pulse motor 5 by means of the reed switch 7 and hence drive the pulse motor 5 to set it to its best position (a preset position) for starting the engine, that is, set the initial air/fuel ratio to a predetermined proper value. The above preset position of the pulse motor 5 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 5 is detected as the position at which the reed switch 7 turns on or off, as previously mentioned with reference to FIG. 1.

Then, ECU 6 monitors the condition of activation of the $O_2$ sensor 9 and the coolant temperature Tw detected by the thermistor 14 to determine whether or not the engine is in a condition for initiation of the air/fuel ratio control. For accurate air/fuel ratio feedback control, it is a requisite that the $O_2$ sensor 9 is fully activated and the engine is in a warmed-up condition. The $O_2$ sensor, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 6, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions have been fulfilled that the sensor produces an activation signal when its output voltage lowers down to a predetermined voltage Vx (e.g., 0.5 volt), a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 5 is held at its predetermined position $PS_{CR}$. The pulse motor 5 is driven to appropriate positions in response to the operating condition of the engine after initiation of the air/fuel ratio control, as hereinlater described.

Basic Air/Fuel Ratio Control

Following the initialization, the program in ECU 6 proceeds to the basic air/fuel ratio control.

ECU 6 is responsive to various detected value signals representing the output voltage of the $O_2$ sensor 9, the absolute pressure in the intake manifold 2 detected by the pressure sensor 12, the engine rpm Ne detected by the rpm sensor 15, and the atmospheric pressure $P_A$ detected by the atmospheric pressure sensor 10, to drive the pulse motor 5 as a function of the values of these signals to control the air/fuel ratio. More specifically, the basic air/fuel ratio control comprises open loop control which is carried out at wide-open-throttle, at engine idle, at engine deceleration, and at engine acceleration at the standing start of the engine, and closed loop control which is carried out at engine partial load. All the control is initiated after completion of the warming-up of the engine.

First, the condition of open loop control at wide-open-throttle is met when the differential pressure $P_A-P_B$ (gauge pressure) between the absolute pressure $P_B$ detected by the pressure sensor 12 and the atmospheric pressure $P_A$ (absolute pressure) detected by the atmospheric pressure sensor 10 is lower than a predetermined value $\Delta P_{WOT}$. ECU 6 compares the difference in value between the output signals of the sensors 10, 12 with the predetermined value $\Delta P_{WOT}$ stored therein, and when the relationship of $P_A-P_B<\Delta P_{WOT}$ stands, drives the pulse motor 5 to a predetermined position (preset position) $PS_{WOT}$ and holds it there.

The condition of open loop control at engine idle is met when the engine rpm Ne is lower than a predetermined idle rpm $N_{IDL}$ (e g., 1,000 rpm). ECU 6 compares the output signal value Ne of the rpm sensor 15 with the predetermined rpm $N_{IDL}$ stored therein, and when the relationship of $Ne<N_{IDL}$ stands, drives the pulse motor 15 to a predetermined idle position (preset position) $PS_{IDL}$ and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 6 compares the output signal value $P_B$ of the pressure sensor 12 with the predetermined value $PB_{DEC}$ stored therein, and when the relationship of $P_B<PB_{DEC}$ stands, drives the pulse motor 5 to a predetermined deceleration position (preset position) $PS_{DEC}$ and holds it there.

The air/fuel ratio control at engine acceleration (i.e., standing start or off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne<N_{IDL}$ to one $Ne\geqq N_{IDL}$. On this occasion, ECU 6 rapidly moves the pulse motor 5 to a predetermined acceleration position (preset position) $PS_{ACC}$, which is immediately followed by initiation of the air/fuel ratio feedback control, described hereinlater.

During operations of the above-mentioned open loop control at wide-open-throttle, at engine idle, at engine deceleration, and at engine off-idle acceleration, the respective predetermined positions $PS_{WOT}$, $PS_{IDL}$, $PS_{DEC}$ and $PS_{ACC}$ for the pulse motor 5 are compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 6 performs selectively feedback control based upon proportional term correction (hereinafter called "P term control") and feedback control based upon integral term correction (hereinafter called "I term control"), in response to the engine rpm Ne detected by the engine rpm sensor 15 and the output signal V of the $O_2$ sensor 9. To be concrete, when the output voltage of the $O_2$ sensor 9 varies only at the higher level side or only at the lower level side with respect to a reference voltage Vref, the position of the pulse motor 5 is corrected by an integral value obtained by integrating the value of a binary signal which changes in dependence on whether the output voltage of the $O_2$ sensor is at the higher level or at the lower level with respect to the predetermined reference voltage Vref (I term control). On the other hand, when the output signal V of the $O_2$ sensor changes from the higher level to the lower level or vice versa, the position of the pulse motor 5 is corrected by a value directly proportional to a change in the output voltage V of the $O_2$ sensor (P term control).

According to the above I term control, the number of steps by which the pulse motor is to be displaced per second is increased with an increase in the engine rpm so that it is larger in a higher engine rpm range.

Whilst, according to the P term control, the number of steps by which the pulse motor is to be displaced per second is set at a single predetermined value (e.g., 6 steps), irrespective of the engine rpm.

In transition from the above-mentioned various open loop control to the closed loop control at engine partial load or vice versa, changeover between open loop mode and closed loop mode is effected in the following manner: First, in changing from closed loop mode to open loop mode, ECU 6 moves the pulse motor 5 to a predetermined position $PS_{CR}$, $PS_{WOT}$, $PS_{IDL}$, $PS_{DEC}$ or $PS_{ACC}$, irrespective of the position at which the pulse motor was located immediately before entering each open loop control. This predetermined position is corrected in response to actual atmospheric pressure as hereinlater referred to.

On the other hand, in changing from open loop mode to closed loop mode, ECU 6 commands the pulse motor 5 to initiate air/fuel ratio feedback control with I term correction.

To obtain optimum exhaust emission characteristics irrespective of changes in the actual atmospheric pressure during open loop air/fuel ratio control or at the time of shifting from open loop mode to closed loop mode, the position of the pulse motor 5 needs to be compensated for atmospheric pressure. According to the invention, the above-mentioned predetermined or preset positions $PS_{CR}$, $PS_{WOT}$, $PS_{IDL}$, $PS_{DEC}$ and $PS_{ACC}$ at which the pulse motor 5 is to be held during the respective open loop control operations are corrected in a linear manner as a function of changes in the atmospheric pressure $P_A$, using the following equation:

$$PSi(P_A)=PSi+(760-P_A)\times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 6.

ECU 6 applies to the above equation the coefficients PSi, Ci which are determined at proper different values according to the kinds of open loop control to be carried out, to calculate by the above equation the position $PSi(P_A)$ for the pulse motor 5 to be set at a required kind of open loop control and moves the pulse motor 5 to the calculated position $PSi(P_A)$.

Figure 2:
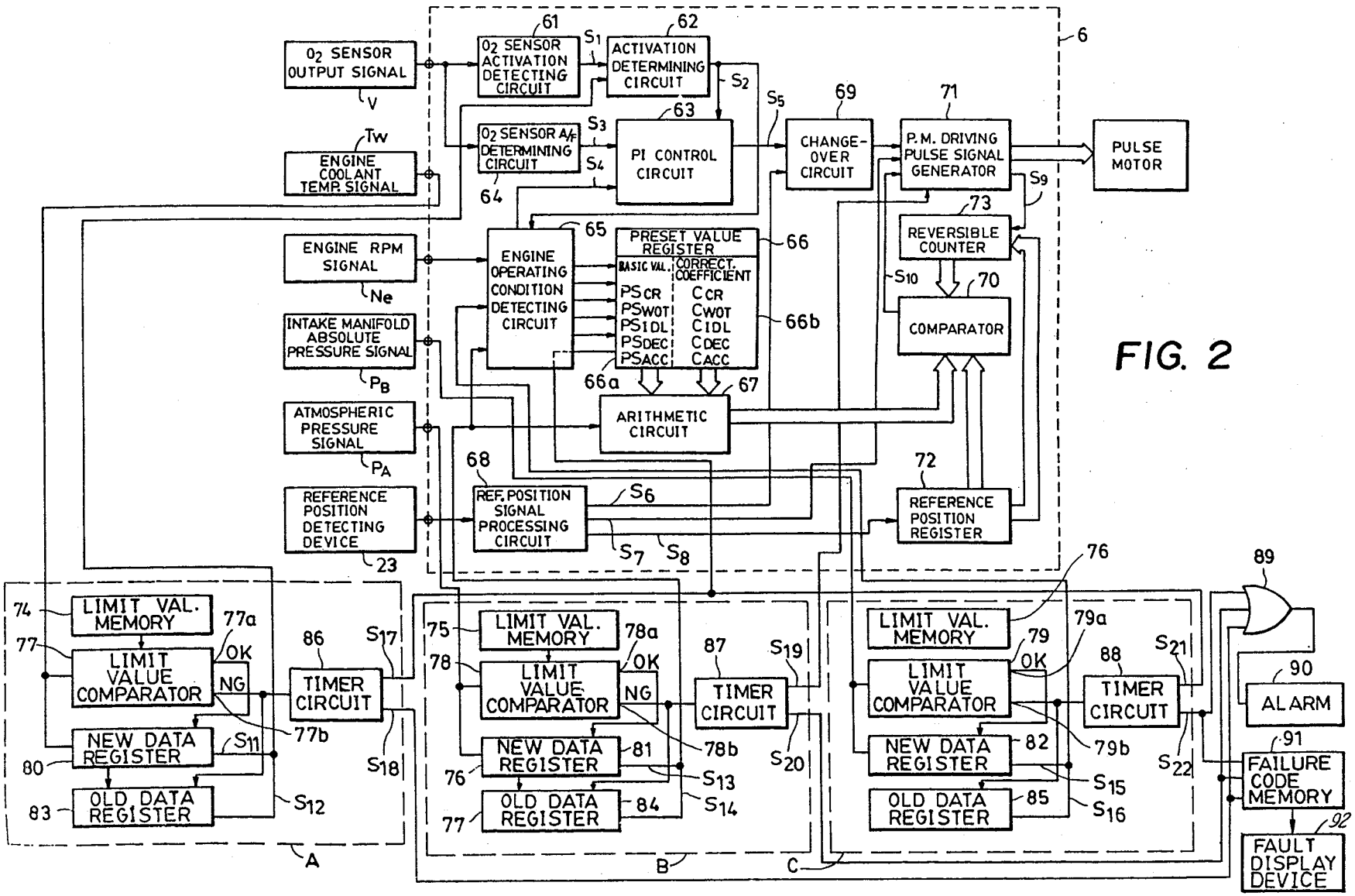
FIG. 2 is a block diagram illustrating an electrical circuit provided with a fail safe function to be executed in the event of sensor failure, which circuit is provided within an electronic control unit appearing in FIG. 1.

FIG. 2 is a block diagram illustrating the interior construction of ECU 6 used in the air/fuel ratio control system having the above-mentioned functions according to the invention. In ECU 6, reference numeral 61 designates a circuit for detecting the activation of the $O_2$ sensor 9 in FIG. 1, which is supplied at its input with an output signal V from the $O_2$ sensor. Upon passage of the predetermined period of time Tx after the voltage of the above output signal V has dropped below the predetermined value Vx, the above circuit 61 supplies an activation signal $S_1$ to an activation determining circuit 62. This activation determining circuit 62 is also supplied at its input with an engine coolant temperature signal Tw from the thermistor 14 in FIG. 1. When supplied with both the above activation signal $S_1$ and the coolant temperature signal Tw indicative of a value exceeding the predetermined value Twx, the activation determining circuit 62 supplies an air/fuel ratio control initiation signal $S_2$ to a PI control circuit 63 to render same ready to operate. Reference numeral 64 represents an air/fuel ratio determining circuit which determines the value of air/fuel ratio of engine exhaust gases, depending upon whether or not the output voltage of the $O_2$ sensor 9 is larger than the predetermined value Vref, to supply a binary signal $S_3$ indicative of the value of air/fuel ratio thus obtained, to the PI control circuit 63. On the other hand, an engine operating condition detecting circuit 65 is provided in ECU 6, which is supplied with an engine rpm signal Ne from the engine rpm sensor 15, an absolute pressure signal $P_B$ from the pressure sensor 12, an atmospheric pressure signal $P_A$ from the atmospheric pressure sensor 10, all the sensors being shown in FIG. 1, and the above control initiation signal $S_2$ from the activation determining circuit 62 in FIG. 2, respectively. The circuit 65 supplies a control signal $S_4$ indicative of a value corresponding to the values of the above input signals to the PI control circuit 63. The PI control circuit 63 accordingly supplies a change-over circuit 69 to be referred to later with a pulse motor control signal $S_5$ having a value corresponding to the air/fuel ratio signal $S_3$ supplied from the air/fuel ratio determining circuit 64 and a signal component corresponding to the engine rpm Ne in the control signal $S_4$ supplied from the engine operating condition detecting circuit 65. The engine operating condition detecting circuit 65 also supplies the PI control circuit 63 with the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine operating condition detecting circuit 65, the PI control circuit 63 interrupts its own operation. Upon interruption of the supply of the above signal component to the control circuit 63, a pulse signal $S_5$ is outputted from the circuit 63 to the change-over circuit 69, which signal starts air/fuel ratio control with integral term correction.

A preset value register 66 is provided in ECU 6, which is formed of a basic value register section **66*a* in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 66*b* in which are stored atmospheric pressure correcting coefficients $C_{CR}$, $C_{WOT}$, $C_{IDL}$, $C_{DEC}$ and $C_{ACC}$ for these basic values. The engine operating condition detecting circuit 65 detects the operating condition of the engine based upon the activation of the $O_2$ sensor and the values of engine rpm Ne, intake manifold absolute pressure $P_B$ and atmospheric pressure $P_A$ to read from the register 66 the basic value of a preset value corresponding to the detected operating condition of the engine and its corresponding correcting coefficient and apply same to an arithmetic circuit 67. The arithmetic circuit 67 performs arithmetic operation responsive to the value of the atmospheric pressure signal $P_A$, using the equation $PSi(P_A)=PSi+(760-P_A)\times Ci$. The resulting preset value is applied to a comparator 70. The above atmospheric pressure signal $P_A$ is supplied to the arithmetic circuit 67 by way of registers 81, 84** as hereinlater described.

On the other hand, a reference position signal processing circuit 68 is provided in ECU 6, which is responsive to the output signal of the reference position detecting device (reed switch) 7, indicative of the switching of same, to generate a binary signal $S_6$ having a certain level from the start of the engine until it is detected that the pulse motor reaches the reference position. This binary signal $S_6$ is supplied to the change-over circuit 69 which in turn keeps the control signal $S_5$ from being transmitted from the PI control circuit 63 to a pulse motor driving signal generator 71 as long as it is supplied with this binary signal $S_6$, thus avoiding the interference of the operation of setting the pulse motor to the initial position with the operation of P-term/I-term control. The reference position signal processing circuit 68 also generates a pulse signal $S_7$ in response to the output signal of the reference position detecting device 7, which signal causes the pulse motor 5 to be driven in the step-increasing direction or in the step-decreasing direction so as to detect the reference position of the pulse motor 5. This signal $S_7$ is supplied directly to the pulse motor driving signal generator 71 to cause same to drive the pulse motor 5 until the reference position is detected. The reference position signal processing circuit 68 generates another pulse signal $S_8$ each time the reference position is detected. This pulse signal $S_8$ is supplied to a reference position register 72 in which the value of the reference position (e.g., 50 steps) is stored. This register 72 is responsive to the above signal $S_8$ to apply its stored value to one input terminal of the comparator 70 and to the input of a reversible counter 73. The reversible counter 73 is also supplied with an output pulse signal $S_9$ generated by the pulse motor driving signal generator 71 to count the pulses of the signal $S_9$ corresponding to the actual position of the pulse motor 5. When supplied with the stored value from the reference position register 72, the counter 73 has its counted value replaced by the value of the reference position of the pulse motor.

The counted value thus renewed is applied to the other input terminal of the comparator 70. Since the comparator 70 has its other input terminal supplied with the same pulse motor reference position value, as noted above, no output signal is supplied from the comparator 70 to the pulse motor driving signal generator 71 to thereby hold the pulse motor at the reference position with certainty. Subsequently, when the $O_2$ sensor 9 remains deactivated, an atmospheric pressure-compensated preset value $PS_{CR}(P_A)$ is outputted from the arithmetic circuit 67 to the one input terminal of the comparator 70 which in turn supplies an output signal $S_{10}$ corresponding to the difference between the preset value $PS_{CR}(P_A)$ and a counted value supplied from the reversible counter 73, to the pulse motor driving signal generator 71, to thereby achieve accurate control of the position of the pulse motor 5. Also, when the other open loop control conditions are detected by the engine operating condition detecting circuit 65, similar operations to that just mentioned above are carried out.

In FIG. 2, blocks A, B and C designate fail safe devices for performing fail safe functions in the event of occurrence of trouble in the engine cooling water sensor 14, the atmospheric pressure sensor 10 and the pressure sensor 12, respectively. In these fail safe devices, limit value memories 74, 75, 76 are provided which store respective upper and lower limits for the engine coolant signal Tw, the atmospheric pressure signal $P_A$ and the intake pipe-absolute pressure signal $P_B$. These stored values in the memories 74, 75, 76 are supplied to limit value comparators 77, 78, 79 through their one input terminals, respectively. The comparators 77, 78, 79 have their other input terminals supplied directly with the engine coolant signal Tw, the atmospheric pressure signal $P_A$ and the absolute pressure signal $P_B$, respectively. The above upper and lower limits are set at values lying slightly beyond a normal range of values indicative of operating condition of the engine and a normal range of values indicative of ambient condition in the vicinity of the engine, which ranges can exist during normal operation of the engine. The above-mentioned signals Tw, $P_A$, $P_B$ are also supplied to new data registers 80, 81, 82 which temporarily store the values of the signals Tw, $P_A$, $P_B$ occurring as of the present time, respectively. The data stored in these new data registers 80, 81, 82 are successively transferred to old data registers 83, 84, 85, respectively, which in turn store these transferred data as data occurring immediately before the occurrence of new data Tw, $P_A$, $P_B$ as of the present time.

The new data register 80 and the old data register 83 which store new and old data of the engine coolant temperature signal Tw, respectively, are both connected at their outputs to the $O_2$ sensor activation determining circuit 62, the new data register 81 and the old data register 84 storing, respectively, new and old data of the atmospheric pressure signal $P_A$ to both the engine operating condition detecting circuit 65 and the arithmetic circuit 67, and the new data register 82 and the old data register 85 storing, respectively, new and old data of the absolute pressure signal $P_B$ to the engine operating condition detecting circuit 65, respectively. These registers 80, 83, 81, 84, 82, 85 in the blocks A, B, C are arranged to have stored values $S_{11}$–$S_{16}$ supplied to the above-mentioned circuits, depending upon output signals of the limit value comparators 77, 78, 79, as described later. The limit value comparators 77, 78, 79 each have two output terminals *77a, 77b; 78a, 78b; 79a, 79b*, of which each one output terminal *77a, 78a, 79a* is connected to a corresponding one of the new data registers 80, 81, 82, and each other output terminal *77b, 78b, 79b* to a corresponding one of the old data registers 83, 84, 85 and a corresponding one of timer circuits 86, 87, 88, respectively. The timer circuits 86, 87, 88 are each adapted to generate a fault-indicative signal $S_{17}$, $S_{18}$, $S_{19}$, $S_{20}$, $S_{21}$, $S_{22}$ upon passage of a predetermined period of time (e.g., 2 seconds) after it is supplied with an NG signal (abnormality-indicative signal) from a corresponding one of the comparators 77, 78, 79 on condition that the above NG signal is continuously generated over the above predetermined period of time. The timer circuits 86, 88 in the blocks A, C each have its output connected, on one hand, to the engine operating condition detecting circuit 65, and on the other hand, to an OR circuit 89 and a failure code memory 91, which is connected to and a fault display device 92, respectively. The above OR circuit 89 has its output connected to an alarm device 90. On the other hand, the timer circuit 87 in the block B has its output connected, on one hand, to the pulse motor driving signal generator 71, and on the other hand, to the above OR circuit 89, and the failure code memory 91 respectively.

The operation of the above-described sensor fail safe arrangements A, B, C will now be described. The signals Tw, $P_A$, $P_B$ outputted, respectively, from the engine coolant temperature sensor 14, the atmospheric pressure sensor 10 and the intake pipe-absolute pressure sensor 12 are applied to the respective comparators 77, 78, 79, which in turn compare the values of these signals with the upper limits and lower limits stored in the respective limit value memories 74, 75, 76. When the values of the signals Tw, $P_A$, $P_B$ fall within the ranges between the upper and lower limits, the respective comparators 77, 78, 79 generate respective OK signals through their respective output terminals *77a, 78a, 79a* and supply them to the respective new data registers 80, 81, 82. These OK signals permit the new values of the signals Tw, $P_A$, $P_B$ to be written into the new data registers 80, 81, 82, enable the values thus stored into the registers 80, 81, 82 to be shifted into the old data registers 83, 84, 85 and read from the registers 80, 81, 82 as outputs $S_{11}$, $S_{13}$, $S_{15}$. In the block A, the new value of the engine coolant temperature signal Tw which is read from the the new data register 80 is applied to the $O_2$ sensor activation determining circuit 62, which supplies the air/fuel ratio control initiation signal $S_2$ to the PI control circuit 63 for initiation of the air/fuel ratio control operation when supplied with both the activation signal $S_1$ from the circuit 61 and the above temperature signal Tw indicative of a value exceeding the predetermined value Twx from the above register 80. On the other hand, in the blocks B, C, the new values of the atmospheric pressure signal $P_A$ and the intake pipe-absolute pressure signal $P_B$ which are read from the new data registers 81, 82 are applied, respectively, to the engine operating condition detecting circuit 65, and to the arithmetic circuit 67 and the circuit 65. The circuits 65, 67 operate on these new value signals $P_A$, $P_B$ to carry out the aforementioned air/fuel ratio control operation.

When the engine coolant temperature signal Tw, the atmospheric pressure signal $P_A$ or the absolute pressure signal $P_B$ shows a value exceeding either one of the corresponding upper limit and the corresponding lower limit, the comparator 77, 78 or 79 supplies an NG signal through its output terminal *77b, 78b* or *79b* to the old data register 83, 84 or 85 to prohibit replacement of the data stored in the old data register 83, 84 or 85 by the data supplied from the new data register 80, 81 or 82, and simultaneously enable the data stored in the register 83, 84 or 85 immediately preceding the generation of the NG signal to be read from the latter register. The stored old data of the signal Tw thus read out is applied to the $O_2$ sensor activation determining circuit 62, that of the signal $P_A$ to the engine operating condition detecting circuit 65 and the arithmetic circuit 67, and that of the signal $P_B$ to the circuit 65, respectively. Then, the circuit 62 executes determination on the activation of the $O_2$ sensor on the basis of the old or immediately preceding value of the engine coolant temperature signal Tw, whereas the circuits 65, 67 carry out the air/fuel ratio control operation in the aforedescribed manner on the basis of the old or immediately preceding values of the atmospheric pressure signal $P_A$ and the absolute pressure signal $P_B$. At the same time, the NG signal, which is outputted from the comparator 77, 78 or 79 in the block A, B or C is supplied to the corresponding timer circuit 86, 87 or 88. In the block A, C, the timer circuit 86, 88 is triggered by such NG signal and applies the corresponding signal $S_{17}$, $S_{21}$ to the engine operating condition circuit 65 when the timer circuit is continuously supplied with the corresponding NG signal for the predetermined period of time (2 seconds). The circuit 65, when supplied with at least one of the signals $S_{17}$, $S_{21}$, applies the control signal $S_4$ containing a signal component corresponding to the value of the signal $S_{17}$, $S_{21}$ to the PI control circuit 63 to immediately interrupt the operation of the same, and simultaneously triggers the preset value register 66 to write its stored basic value $PS_{IDL}$ and correcting coefficient $C_{IDL}$ applicable at engine idle, into the arithmetic circuit 67. The arithmetic circuit 67 then operates on these values to calculate an atmospheric compensated value $PS_{IDL}(P_A)$ and applies it to the comparator 70 so that the pulse motor driving signal generator 71, which operates on the output of the comparator 70, drives the pulse motor 5 to the above preset position $PS_{IDL}(P_A)$ and holds it there, in the aforementioned manner. Instead of this idle position $PS_{IDL}(P_A)$, the pulse motor may be set to a predetermined position $PS_{FS}$ specially provided, on the above-mentioned occasion.

On the other hand, in the block B, the timer circuit 87, when continuously supplied with the NG signal from the comparator 78 for the predetermined period of time (2 seconds), applies the fault-indicative signal $S_{19}$ to the pulse motor driving signal generator 71 to immediately interrupt its operation. Since on this occasion the pulse motor is driven for control of the air/fuel ratio in response to the atmospheric pressure value immediately preceding the generation of the NG signal once the same NG signal is generated, as previously mentioned, the pulse motor is held at a position immediately preceding the generation of the fault-indicative signal $S_{19}$.

In addition to the above-mentioned pulse motor control operations, the timer circuit 86, 87 or 88 in the block A, B or C, when continuously supplied with the corresponding NG signal for the aforementioned predetermined period of time, applies the signal $S_{18}$, $S_{20}$ or $S_{22}$ to the alarm device 90 through the OR circuit 89, and directly to the failure code memory 91 to actuate them to carry out their respective operations. When supplied with one of these signals, the failure code memory 91 memorizes a predetermined code corresponding to the input signal, i.e. the faulty sensor, and applies a signal indicative of the memorized code to the fault display device 92 which is energized.

Incidentally, the timer circuit 86, 87 or 88 has its operation interrupted when the supply of the corresponding NG signal thereto is interrupted before the lapse of the predetermined period of time (2 seconds) so that the signals $S_{17}$, $S_{18}$; $S_{19}$, $S_{20}$ or $S_{21}$, $S_{22}$ are not generated from the timer circuit 86, 87 or 88. Further, the air/fuel ratio control operation is continued until the above predetermined period of time passes after the generation of an NG signal, on the basis of the old or immediately preceding values of the engine coolant temperature signal Tw, the atmospheric pressure signal $P_A$ and the absolute pressure signal $P_B$ which are supplied from the old data registers 83, 84, 85 in the form of the signals $S_{12}$, $S_{14}$, $S_{16}$.

What is claimed is:

1. An electric control system for controlling an internal combustion engine, which comprises: sensor means for detecting at least one of the operating conditions of said engine and an ambient condition in the vicinity of said engine to generate an output continuously variable with a change in said at least one condition; means operable in response to said output of said sensor means for controlling the operation of said engine; comparator means for comparing said output of said sensor means with an upper limit and a lower limit which are set at values lying slightly beyond a normal range of values indicative of said at least one condition which can exist during normal operation of said engine, said comparator means being adapted to generate a first signal when said output of said sensor means lies beyond said upper limit or said lower limit; and a timer arranged to generate a second signal when said first signal is continuously generated for a predetermined period of time, and means for causing an output of said sensor means which is generated substantially immediately before the generation of said first signal, to be used for control of the engine until said second signal is generated after the generation of said first signal.

2. An air/fuel ratio control system for performing feedback control of the air/fuel ratio of an air/fuel mixture being supplied to an internal combustion engine having an intake pipe, said system comprising: an $O_2$ sensor for detecting the concentration of an exhaust gas ingredient emitted from said engine; a carburetor for producing said mixture being supplied to said engine; and means operatively connecting said $O_2$ sensor with said carburetor in a manner effecting feedback control operation to control the air/fuel ratio of said mixture to a predetermined value in response to an output signal generated by said $O_2$ sensor, said connecting means comprising an electrical circuit, an air/fuel ratio control valve and a pulse motor responsive to a control signal generated by said electrical circuit to drive said air/fuel ratio control valve; and sensor means for detecting at least one of operating condition of said engine and ambient condition in the vicinity of said engine to generate an output continuously variable with a change in said at least one condition; said electrical circuit including means responsive to the output of said sensor means for determining whether to effect said feedback control operation and thereby generate a first signal indicative of the result of said determination, means responsive to said first signal for selectively generating said control signal dependant upon the output of said $O_2$ sensor when said feedback control operation is effected, or said control signal dependent upon the output of said sensor means when said feedback control operation is not effected, comparator means for comparing said output of said sensor means with an upper limit and a lower limit which are set at values lying slightly beyond a normal range of values indicative of said at least one condition, said comparator means being adapted to generate a second signal when said output of said sensor means lies beyond said upper limit or said lower limit, a timer arranged to generate a third signal when said second signal is continuously generated for a predetermined period of time and means for causing an output of said sensor means which is generated immediately before the generation of said second signal, to be used for control of the air/fuel ratio of said mixture, until said third signal is generated after the generation of said second signal.

3. The air/fuel ratio control system as claimed in claim 2, wherein said electrical circuit further includes means responsive to said second signal to perform an alarm action.

4. The air/fuel ratio control system as claimed in claim 2 wherein said electrical circuit further includes means responsive to said second signal to memorize a predetermined failure code corresponding to said sensor means, and to display occurrence of a fault in said sensor means.

5. The air/fuel ratio control system as claimed in claim 2, wherein said electrical circuit further includes means responsive to said second signal to move said pulse motor to a position at which said pulse motor was located immediately before the generation of said second signal, and hold same there.

6. The air/fuel ratio control system as claimed in claim 2, wherein said electrical circuit further includes means responsive to said second signal to move said pulse motor to a predetermined position, and hold same there.

7. The air/fuel ratio control system as claimed in any one of claims 2, 3, 4, 5 or 6, wherein said sensor means includes a sensor for detecting atmospheric pressure.

8. The air/fuel ratio control system as claimed in any one of claims 2, 3, 4, 5 or 6, wherein said sensor means includes a sensor for detecting absolute pressure present in said intake pipe.

9. The air/fuel ratio control system as claimed in any one of claims 2, 3, 4, 5 or 6, wherein said sensor means includes a sensor for detecting the temperature of engine cooling water.

10. An air/fuel ratio control system for performing feedback control of the air/fuel ratio of an air/fuel mixture being supplied to an internal combustion engine having an intake pipe, said system comprising: an $O_2$ sensor for detecting the concentration of an exhaust gas ingredient emitted from said engine; a carburetor for producing said mixture being supplied to said engine; and means operatively connecting said $O_2$ sensor with said carburetor in a manner effecting feedback control operation to control the air/fuel ratio of said mixture to a predetermined value in response to an output signal generated by said $O_2$ sensor, said connecting means comprising an electrical circuit, an air/fuel ratio control valve and a pulse motor responsive to a control signal generated by said electrical circuit to drive said air/fuel ratio control valve and sensor means for detecting at least one of operating condition of said engine and ambient condition in the vicinity of said engine to generate an output continuously variable with a change in said at least one condition; said electrical circuit including means responsive to the output of said sensor means for determining whether to effect said feedback control operation and thereby generate a first signal indicative of the result of said determination, means responsive to said first signal for selectively generating said control signal dependent upon the output of said $O_2$ sensor when said feedback control operation is effected, or said control signal dependent upon the output of said sensor means when said feedback control operation is not effected, comparator means for comparing said output of said sensor means with an upper limit and a lower limit which are set at values lying slightly beyond a normal range of values indicative of said at least one condition, said comparator means being adapted to generate a second signal when said output of said sensor means lies beyond said upper limit or said lower, a timer arranged to generate a third signal when said second signal is continuously generated for a predetermined period of time and means responsive to said third signal to hold said pulse motor at a position at which said pulse motor was located immediately before the generation of said third signal.

11. An air/fuel ratio control system for performing feedback control of the air/fuel ratio of an air/fuel mixture being supplied to an internal combustion engine having an intake pipe, said system comprising: an $O_2$ sensor for detecting the concentration of an exhaust gas ingredient emitted from said engine; a carburetor for producing said mixture being supplied to said engine; and means operatively connecting said $O_2$ sensor with said carburetor in a manner effecting feedback control operation to control the air/fuel ratio of said mixture to a predetermined value in response to an output signal generated by said $O_2$ sensor, said connecting means comprising an electrical circuit, and air/fuel ratio control valve and a pulse motor responsive to a control signal generated by said electrical circuit to drive said air/fuel ratio control valve; and sensor means for detecting at least one of operating condition of said engine and ambient condition in the vicinity of said engine to generate an output continuously variable with a change in said at least one condition; said electrical circuit including means responsive to the output of said sensor means for determining whether to effect said feedback control operation and thereby generate a first signal indicative of the result of said determination, means responsive to said first signal for selectively generating said control signal dependent upon the output of said $O_2$ sensor when said feedback control operation is effected, or said control signal dependent upon the output of said sensor means when said feedback control operation is not effected, comparator means for comparing said output of said sensor means with an upper limit and a lower limit which are set at values lying slightly beyond a normal range of values indicative of said at least one condition, said comparator means being adapted to generate a second signal when said output of said sensor means lies beyond said upper limit or said lower limit, a timer arranged to generate a third signal when said second signal is continuously generated for a predetermined period of time, means for causing an output of said sensor means which is generated substantially immediately before the generation of said second signal, to be used for the control of the air/fuel ratio of said mixture, until said third signal is generated after the generation of said second signal, and means responsive to said third signal to memorize a predetermined failure code corresponding to said sensor means, and to display occurrence of a fault in said sensor means.

12. A method of controlling an internal combustion engine comprising detecting at least one of the operating conditions of said engine and an ambient condition in the vicinity of said engine to generate an output continuously variable with a change in said at least one condition for controlling the operation of said engine in response to said output; comparing said output with an upper limit and a lower limit which are set at values slightly beyond a normal range of values indicative of said at least one condition which can exist during normal operation of said engine, generating a first signal when said output lies beyond said upper limit or said lower limit; generating a second signal when said first signal is continuously generated for a predetermined period of time, and causing an output which is generated substantially immediately before the generation of said first signal to be used for control of the engine, until said second signal is generated after the generation of said first signal.

* * * * *

UNITED STATES PATENT AND TRADEMARK OFFICE

CERTIFICATE OF CORRECTION

PATENT NO. : 4,450,812

DATED : May 29, 1984

INVENTOR(S) : Kazuo Otsuka, Shin Narasaka & Shumpei Hasegawa

It is certified that error appears in the above—identified patent and that said Letters Patent is hereby corrected as shown below:

In the Abstract, line 14, after "second signal" and before "is continuously" insert the following:

"indicative of the occurrence of trouble when the first signal"

Signed and Sealed this

*Twenty-sixth* Day of *November 1985*

[SEAL]

*Attest:*

DONALD J. QUIGG

*Attesting Officer*

*Commissioner of Patents and Trademarks*